US007598665B2

(12) United States Patent
Li et al.

(10) Patent No.: US 7,598,665 B2
(45) Date of Patent: Oct. 6, 2009

(54) FIELD EMISSION DEVICE AND OPERATING METHOD FOR FIELD EMISSION DEVICE

(75) Inventors: Jung Yu Li, Taipei County (TW); Shih-Pu Chen, Hsinchu (TW); Yi-Ping Lin, Changhua County (TW); Jau-Chyn Huang, Hsinchu (TW); Ching-Sung Hsiao, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 705 days.

(21) Appl. No.: 11/264,318

(22) Filed: Nov. 1, 2005

(65) Prior Publication Data

US 2007/0096075 A1 May 3, 2007

(30) Foreign Application Priority Data

Jul. 26, 2005 (TW) ..... 94125320 A

(51) Int. Cl.
*H01J 63/04* (2006.01)

(52) U.S. Cl. ..... 313/495; 313/310; 313/496

(58) Field of Classification Search ..... 313/495–497, 313/309, 310, 336, 351, 304, 302; 445/23–25; 315/169.1, 169.3
See application file for complete search history.

(56) References Cited

U.S. PATENT DOCUMENTS 5,170,093 A * 12/1992 Yamamoto et al. ..... 313/402
5,965,971 A * 10/1999 Karpov ..... 313/309
6,250,984 B1 * 6/2001 Jin et al. ..... 445/51
6,445,122 B1 * 9/2002 Chuang et al. ..... 313/495
6,541,906 B2 * 4/2003 Lee et al. ..... 313/495
2002/0175617 A1 11/2002 Lee et al.
2005/0062390 A1 3/2005 Takeuchi et al.

FOREIGN PATENT DOCUMENTS

JP 10-116576 5/1998

OTHER PUBLICATIONS

J.L. Kwo et al., "Characteristics of flat panel display using carbon nanotubes as electron emitters", *Diamond and Related Matters*, vol. 9, pp. 1270-1274 (2000).
Yung-Chiang Lan et al., "Simulation study of carbon nanotube field emission display with under-gate and planar-gate structures", *J. Vac. Sci. Technol., American Vacuum Society*, vol. B 22(3), pp. 1244-1249 (2004).

* cited by examiner

*Primary Examiner*—Joseph L Williams
(74) *Attorney, Agent, or Firm*—Quintero Law Office

(57) ABSTRACT

A field emission device includes a substrate, a first conductive layer formed over the substrate biased at a first voltage level, a second conductive layer formed over the substrate biased at a second voltage level different from the first voltage level, emitters formed on the first conductive layer and the second conductive layer for transmitting electrons, and a phosphor layer formed over the substrate and being disposed between the first conductive layer and the second conductive layer, wherein the electrons are transmitted from one of the first conductive layer and the second conductive layer through the phosphor layer to the other of the first conductive layer and the second conductive layer in a direction substantially orthogonal to the normal direction of the substrate.

46 Claims, 13 Drawing Sheets

FIELD EMISSION DEVICE AND OPERATING METHOD FOR FIELD EMISSION DEVICE

BACKGROUND OF THE INVENTION

The present invention generally relates to an electron emitting device and, more particularly, to a field emission display device and a method of operating the same.

In recent years, flat-panel display devices have been developed and widely used in electronic applications. Examples of flat-panel display devices include the liquid crystal display ("LCD"), plasma display panel ("PDP") and field emission display ("FED") devices. FEDs have received considerable attention as a next generation display device having the advantages of LCDs and PDPs. FEDs, which operate on the principle of field emission of electrons from microscopic tips, are known to be capable of overcoming some of the limitations and provides significant advantages over conventional LCDs and PDPs. For example, FEDs have higher contrast ratios, wider viewing angles, higher maximum brightness, lower power consumption, shorter response times and broader operating temperature ranges compared to conventional LCDs and PDPs. Consequently, FEDs are used in a wide variety of applications ranging from home televisions to industrial equipment and computers.

With the property of self-luminescence, an FED may function to serve as an independent light source rather than a display device. The principle of field emission of electrons is briefly discussed by reference to FIG. 1. FIG. 1 is a schematic diagram of a conventional field emission display ("FED") device 10. Referring to FIG. 1, FED device 10 includes a cathode 12, emitters 13 formed on cathode 12, an anode 14, a phosphor layer 16 formed on a surface (not numbered) of anode 14, and spacers 18. Emitters 13 emit electrons, which are accelerated in an electrical field established between cathode 12 and anode 14 toward phosphor layer 16. The direction of the electrical field is substantially in parallel to the normal direction of cathode 12 or anode 14. Phosphor layer 16 provides luminescence when the emitted electrons collide with phosphor particles. Light provided from phosphor layer 16 transmits through anode 14 to a display device (not shown), for example, an LCD device. Spacers 18 are disposed between cathode 12 and anode 14 for maintaining a predetermined spacing therebetween. Spacers 18 may be affixed to cathode 12 and anode 14 by a glass fit sealant. The inner space defined by cathode 12, anode 14 and spacers 18 is required to be maintained at a vacuum state to ensure continued accurate emission of electrons.

The conventional FED device 10 may have the following disadvantages. The property of field emission of FED device 10 is highly sensitive to the distance between cathode 12 and anode 14. The distance must be precisely controlled with a tolerance in the order of micrometer (μm), which hinders FED device 10 from size upgrades and renders uniform luminescence from FED device 10 difficult. Furthermore, as an element in the optical path, anode 14 may attenuate or even block light provided from phosphor layer 16. To avoid such a risk, anode 14 often employs a transparent material such as indium tin oxide ("ITO"). The transparent material is usually expensive relative to the overall cost of FED device 10. The above-mentioned disadvantages, including the relatively small tolerance in distance control and the cost inefficiency in the use of a transparent anode, render it difficult for FED device 10 to be market available.

BRIEF SUMMARY OF THE INVENTION

The present invention is directed to a field emission display device and a method for operating the field emission display device that obviate one or more problems resulting from the limitations and disadvantages of the prior art.

In accordance with an embodiment of the present invention, there is provided a field emission device that comprises a substrate, a first conductive layer formed over the substrate biased at a first voltage level, a second conductive layer formed over the substrate biased at a second voltage level different from the first voltage level, emitters formed on the first conductive layer and the second conductive layer for transmitting electrons, and a phosphor layer formed over the substrate being disposed between the first conductive layer and the second conductive layer, wherein the electrons are transmitted from one of the first conductive layer and the second conductive layer through the phosphor layer to the other of the first conductive layer and the second conductive layer in a direction substantially orthogonal to the normal direction of the substrate.

Also in accordance with the present invention, there is provided a field emission device that comprises a substrate, a first electrode formed over the substrate biased at a first voltage level, a second electrode formed over the substrate biased at a second voltage level greater than the first voltage level, first emitters corresponding to the first electrode for emitting electrons in a direction substantially orthogonal to the normal direction of the substrate, and second emitters corresponding to the second electrode for receiving electrons emitted from the first emitters.

Further in accordance with the present invention, there is provided a field emission device that comprises a first electrode formed on a surface, a second electrode formed on substantially the same surface being spaced apart from the first electrode, and emitters formed on the first electrode and the second electrode for transmitting electrons in a direction substantially orthogonal to the normal direction of the surface.

Still in accordance with the present invention, there is provided a field emission device that comprises a substrate, a plurality of first electrodes formed over the substrate being biased at a first voltage level, a plurality of second electrodes formed over the substrate being biased at a second voltage level different from the first voltage level, a plurality of phosphor layers formed over the substrate, each of the plurality of phosphor layers being disposed between one of the plurality of first electrodes and one of the plurality of second electrodes, and emitters formed on each of the plurality of first electrodes and each of the plurality of second electrodes for transmitting electrons through the plurality of phosphor layers.

Yet still in accordance with the present invention, there is provided a field emission device that comprises a substrate, a first unit for red light emission formed over the substrate including a first cathode, a first anode and a first phosphor layer disposed between the first cathode and the first anode, a second unit for green light emission formed over the substrate including a second cathode, a second anode and a second phosphor layer disposed between the second cathode and the second anode, a third unit for blue light emission formed over the substrate including a third cathode, a third anode and a third phosphor layer disposed between the third cathode and the third anode, and emitters formed on each of the first, second and third cathodes and each of the first, second and third anodes for transmitting electrons through the first, second and third phosphor layers.

Also in accordance with the present invention, there is provided a method of operating a field emission device that comprises providing a substrate, providing a first conductive layer over the substrate, providing a second conductive layer over the substrate, providing emitters on the first conductive layer and the second conductive layer, providing a phosphor layer over the substrate between the first conductive layer and the second conductive layer, biasing the first conductive layer at a first voltage level, biasing the second conductive layer at a second voltage level different from the first voltage level, and emitting electrons from one of the first conductive layer and the second conductive layer to the other of the first conductive layer and the second conductive layer through the phosphor layer in a direction substantially orthogonal to the normal direction of the substrate.

Still in accordance with the present invention, there is provided a method of operating a field emission device that comprises providing a substrate, providing a first electrode over the substrate, biasing the first electrode at a first voltage level, providing a second electrode over the substrate, biasing the second electrode at a second voltage level greater than the first voltage level, providing first emitters corresponding to the first electrode, providing second emitters corresponding to the second electrode; and emitting electrons from the first emitters to the second emitters in a direction substantially orthogonal to the normal direction of the substrate.

Yet still in accordance with the present invention, there is provided a method of operating a field emission device that comprises providing a first electrode on a surface providing a second electrode on substantially the same surface being spaced apart from the first electrode, providing emitters on the first electrode and the second electrode, and transmitting electrons in a direction substantially orthogonal to the normal direction of the surface.

BRIEF DESCRIPTION OF THE SEVERAL VIEWS OF THE DRAWINGS

The foregoing summary as well as the following detailed description of the preferred embodiments of the present invention will be better understood when read in conjunction with the appended drawings. For the purposes of illustrating the invention, there are shown in the drawings embodiments which are presently preferred. It is understood, however, that the invention is not limited to the precise arrangements and instrumentalities shown. In the drawings.

DETAILED DESCRIPTION OF THE INVENTION

Figure 1:
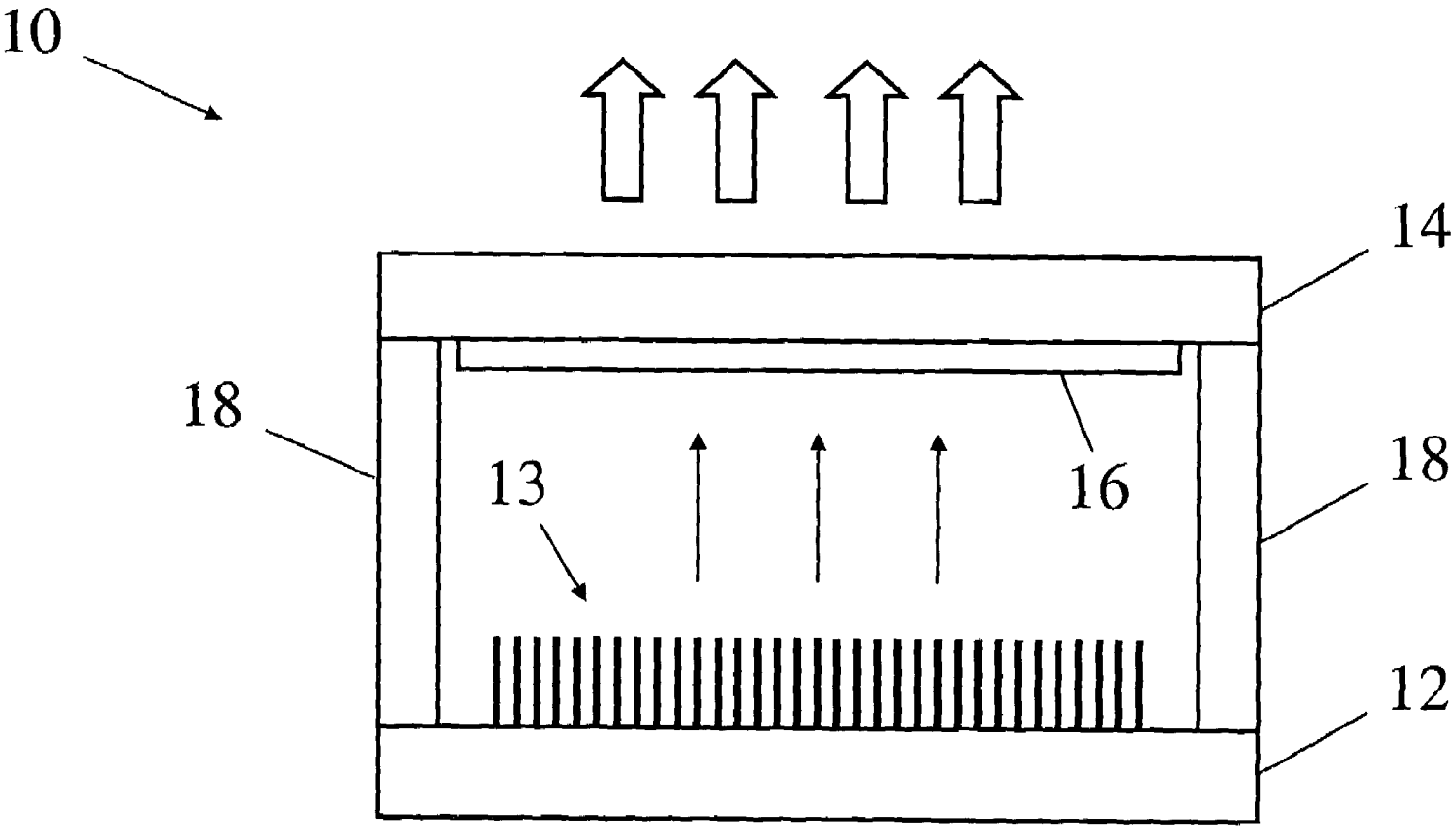
FIG. 1 (PRIOR ART)
FIG. 1 is a schematic diagram of a conventional field emission display ("FED") device.
Figure 2A:
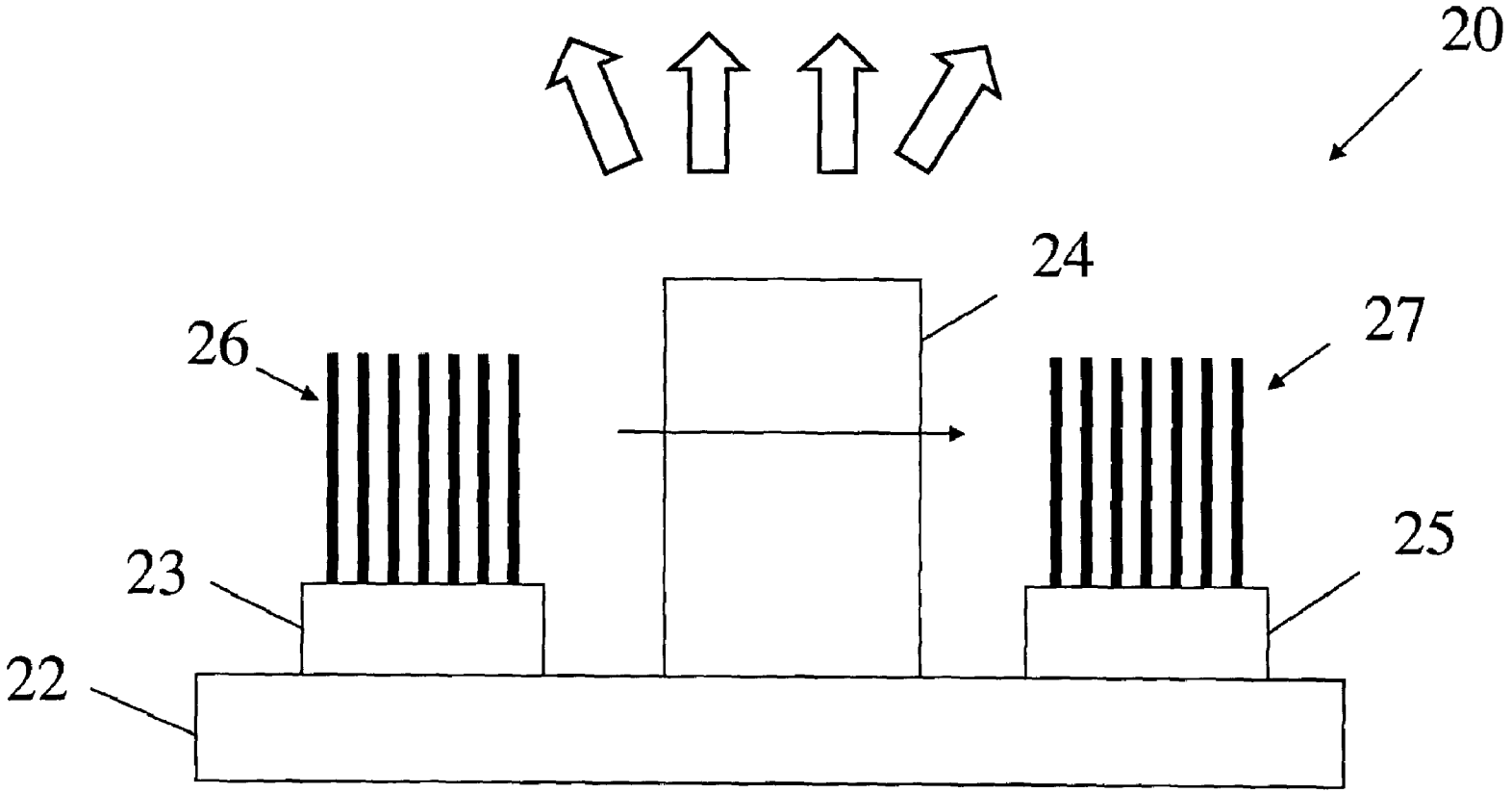
FIG. 2A is a schematic diagram of an FED device in accordance with one embodiment of the present invention.

FIG. 2A is a schematic diagram of an FED device 20 in accordance with one embodiment of the present invention. referring to FIG. 2A, FED device 20 includes a substrate 22, a first conductive layer 23, a second conductive layer 25, a phosphor layer 24 and emitters 26 and 27. Substrate 22 includes but is not limited to the material selected from one of glass, polymer, Teflon or ceramic, which is suitable for providing electrical isolation. Alternatively, substrate 22 includes a silicon base on which a silicon oxide film such as $SiO_2$ or a silicon nitride film such as $Si_3N_4$ is formed. First conductive layer 23, formed on substrate 22, is biased at a first voltage level. Second conductive layer 25, formed on substrate 22, is biased at a second voltage level greater than the first voltage level. First conductive layer 23 and second conductive layer 25 may be formed by an E-gun (electric-gun) deposition process or a sputtering process. First conductive layer 23 and second conductive layer 25 function as a cathode and anode of FED device 20, respectively. The magnitude of the first voltage level and the second voltage level depends on the distance between first conductive layer 23 and second conductive layer 25, the material of emitters 26 and 27, and the working voltage of phosphor 24. In one embodiment according to the present invention, an electrical field established between first conductive layer 23 and second conductive layer 25 is approximately 5 V/μm. Suitable materials for first conductive layer 23 and second conductive layer 25 include but are not limited to Fe, Co and Ni with a thickness of approximately 10 nanometer (nm).

Emitters 26 and 27 are respectively formed on first conductive layer 23 and second conductive layer 25 by, for example, chemical vapor deposition ("CVD"), plasma-enhanced chemical vapor deposition ("PECVD"), thermal chemical vapor deposition or by other suitable chemical-physical deposition methods such as reactive sputtering, ion-beam sputtering, and dual ion beam sputtering. Emitters 26 and 27 include but are not limited to the material selected from one of carbon nano material, metal oxide or metal. In one embodiment, emitters 26 and 27 include one of carbon nanotube, carbon nanosheet, carbon nanowall, diamond film, diamond-like carbon film, GaN, GaB, Si, metal film such as W and Mo, ZnO nanorod or spindle array. The height of emitters 26 and 27 is approximately 1 to 3 μm (micrometer).

Emitters 26 and 27 function to emit electrons. Specifically, emitted electrons are accelerated in an electric field (illustrated in a solid arrow) from first conductive layer 23 through phosphor layer 24 to second conductive layer 25. In one embodiment according to the present invention, the voltage levels of first conductive layer 23 and second metal layer 25 are approximately 0 volts and 300 to 1000 volts, respectively. When the emitted electrons strike phosphor particles, phosphor layer 24 provides luminescence (illustrated in broad arrows), including colored luminescence such as red (R), green (G) and blue (B) light emission. Phosphor layer 24 may be formed by a spin coating process, dip coating or sputter deposition and has a thickness in the order of several micrometers.

Figure 2B:
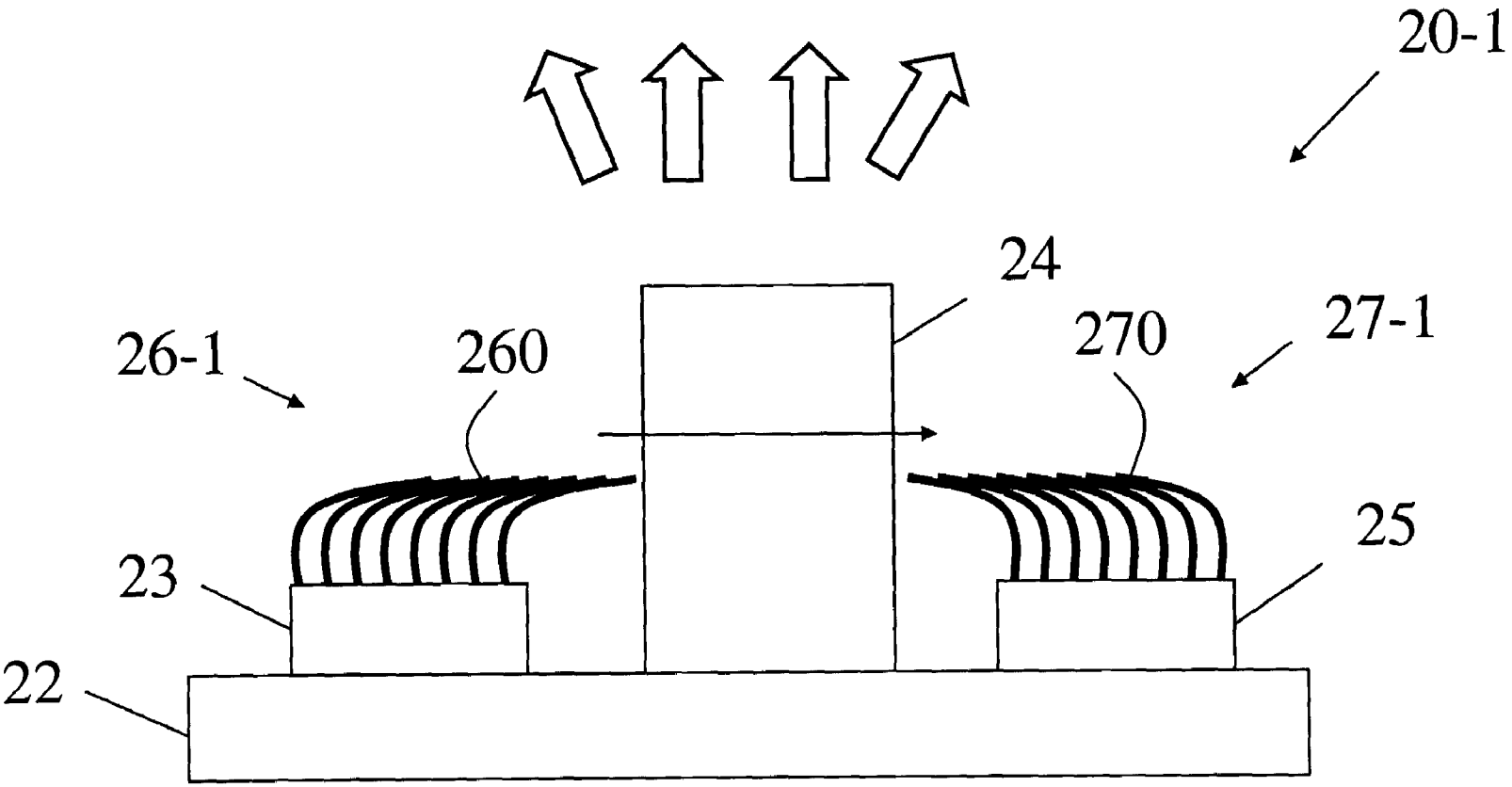
FIG. 2B is a schematic diagram of an FED device in accordance with another embodiment of the present invention.

FIG. 2B is a schematic diagram of an FED device 20-1 in accordance with another embodiment of the present invention. Referring to FIG. 2B, FED device 20-1 has a similar structure to FED 20 shown in FIG. 2A except emitters 26-1 and 27-1. Each of emitters 26-1 includes a tip portion 260 directed in a direction to facilitate transmission of the emitted electrons. Specifically, tip portions 260 are directed in substantially the same direction as the electric field to facilitate emission of electrons. On the other hand, each of emitters 27-1 includes a tip portion 270 directed in a direction to facilitate transmission of the emitted electrons. Specifically, tip portions 270 are directed in substantially the opposite direction to the electric field to facilitate reception of emitted electrons.

Figure 3:
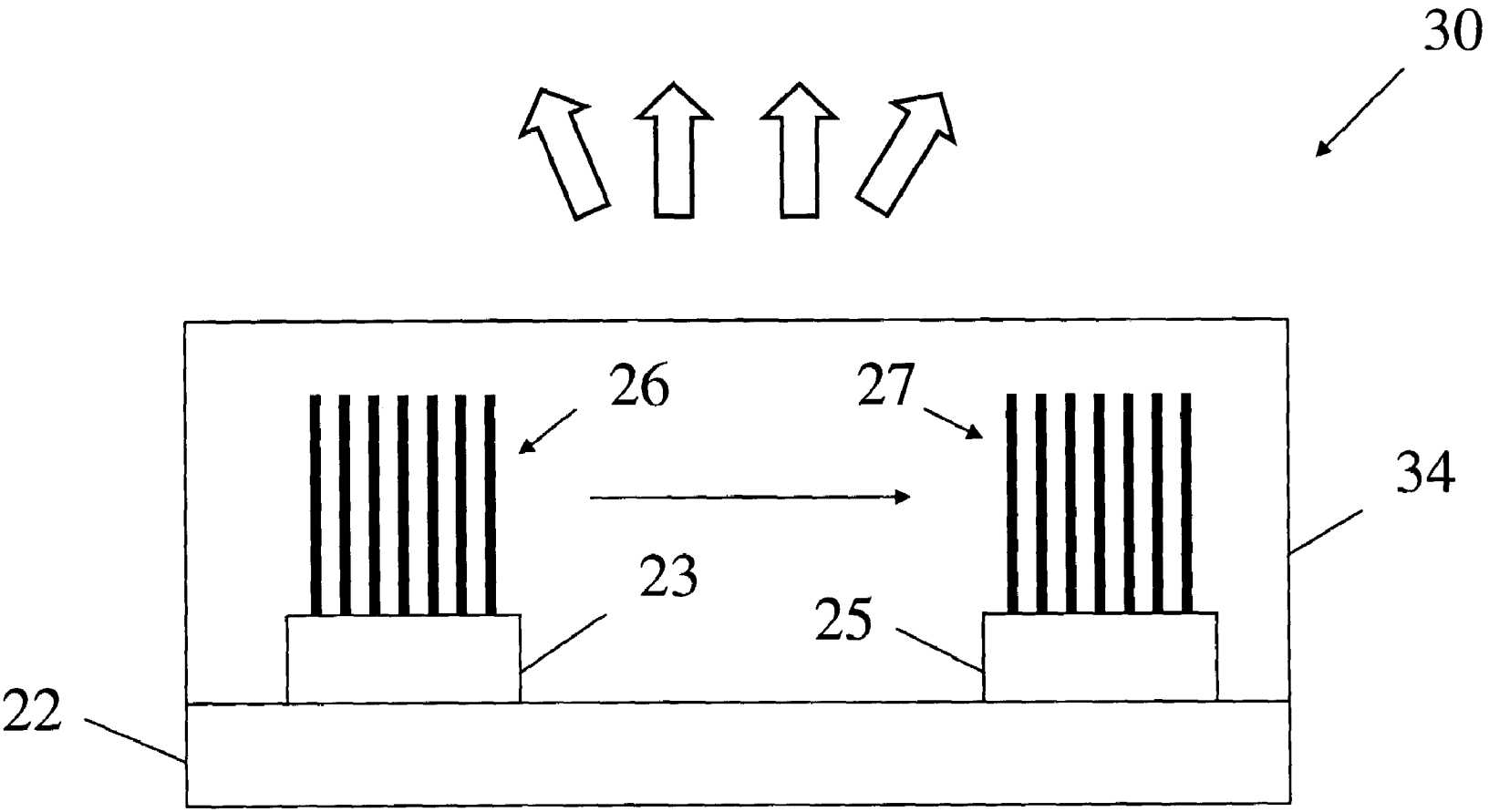
FIG. 3 is a schematic diagrams of an FED device in accordance with still another embodiment of the present invention.

FIG. 3 is a schematic diagrams of an FED device 30 in accordance with still another embodiment of the present invention. Referring to FIG. 3, FED device 30 has a similar structure to FED 20 shown in FIG. 2A except phosphor layer 34. Unlike phosphor layer 24, which is disposed between first conductive layer 23 and second conductive layer 25, phosphor layer 34 covers first conductive layer 23 and second conductive layer 25 of FED device 30.

Figure 4A:
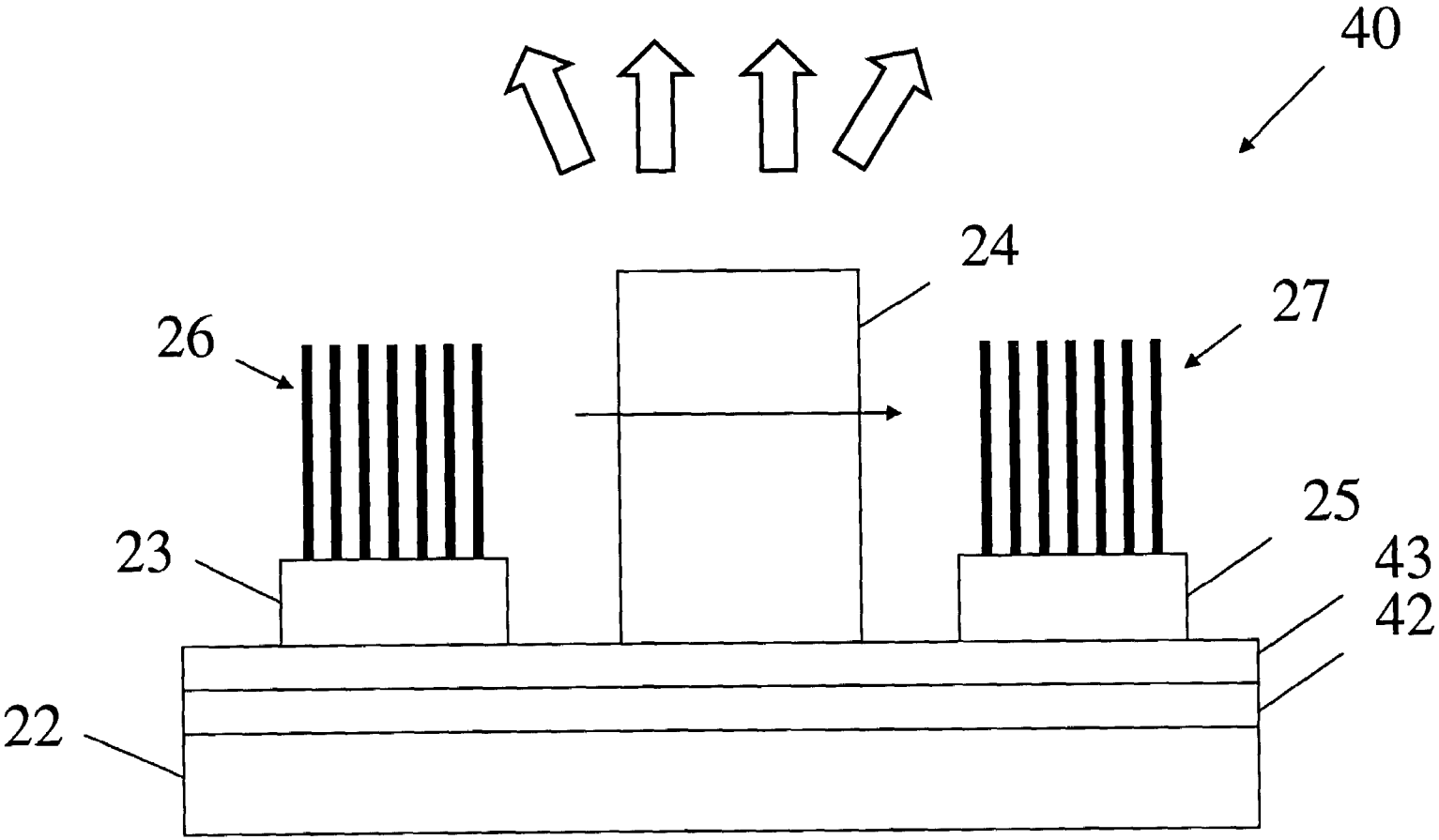
FIG. 4A is a schematic diagram of an FED device in accordance with yet another embodiment of the present invention.

FIG. 4A is a schematic diagram of an FED device 40 in accordance with yet another embodiment of the present invention. Referring to FIG. 4A, FED device 40 has a similar structure to FED 20 shown in FIG. 2A except a reflecting layer 42 and a dielectric layer 43. Reflecting layer 42, having a thickness in the order of one micrometer, is formed on substrate 20 by, for example, a physical vapor deposition ("PVD") process. Suitable material for reflecting layer 42 includes but is not limited to one of Al or Ag. Dielectric layer 43, having a thickness in the order of several micrometers, is formed on reflecting layer 42 by, for example, a thermal process. Suitable material for dielectric layer 43 includes but is not limited to one of silicon oxide such as $SiO_2$ or silicon nitride such as $Si_3N_4$.

Figure 4B:
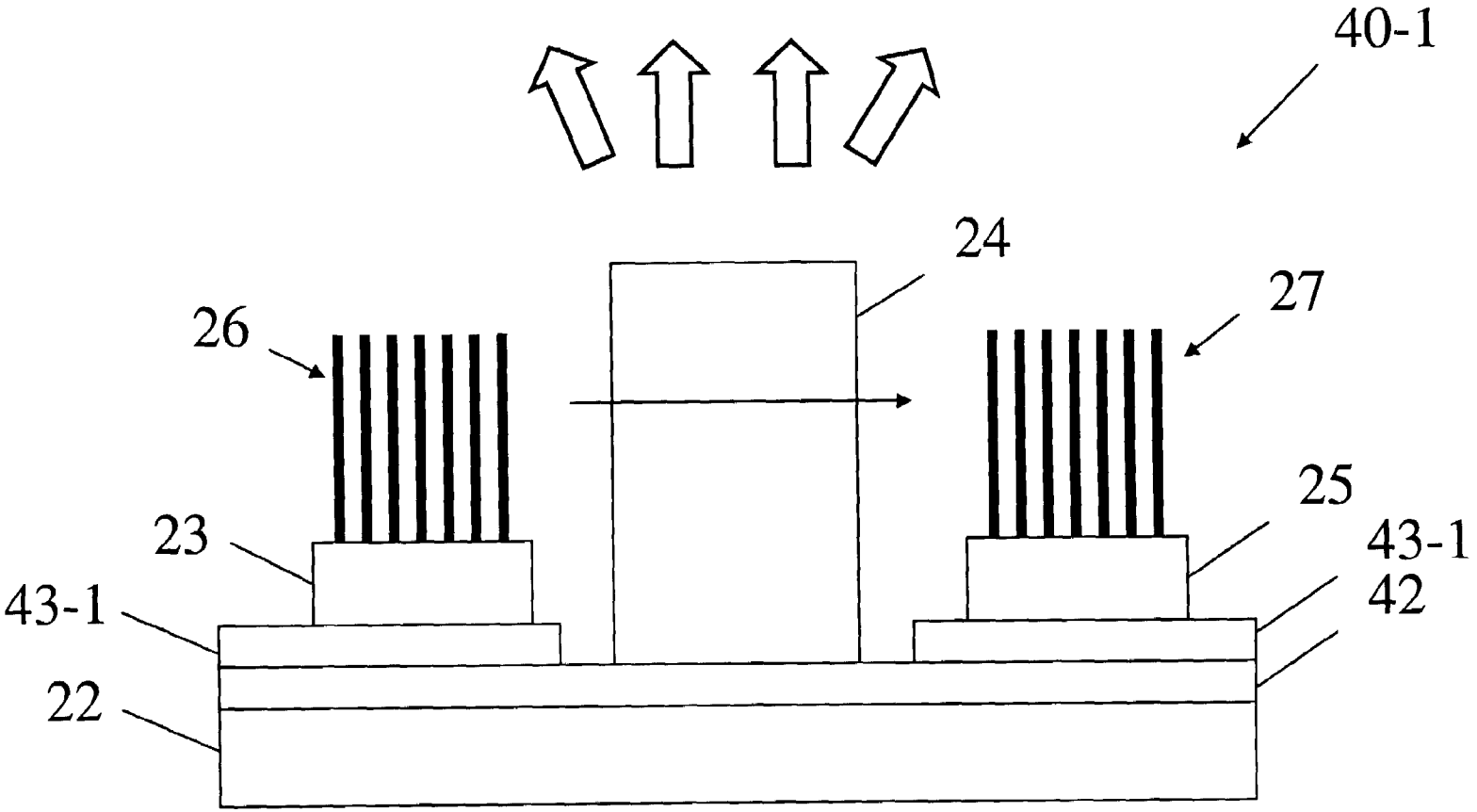
FIG. 4B is a schematic diagram of an FED device in accordance with yet still another embodiment of the present invention.

FIG. 4B is a schematic diagram of an FED device 40-1 in accordance with yet still another embodiment of the present invention. Referring to FIG. 4B, FED device 40-1 has a similar structure to FED 40 shown in FIG. 4A except dielectric layer 43-1. Unlike dielectric layer 43, which is a continuous film formed on reflecting layer 42, dielectric layer 43-1 is not continuous at the region where phosphor layer 24 is located. As a result, phosphor layer 24 is disposed on reflecting layer 42.

Figure 5A:
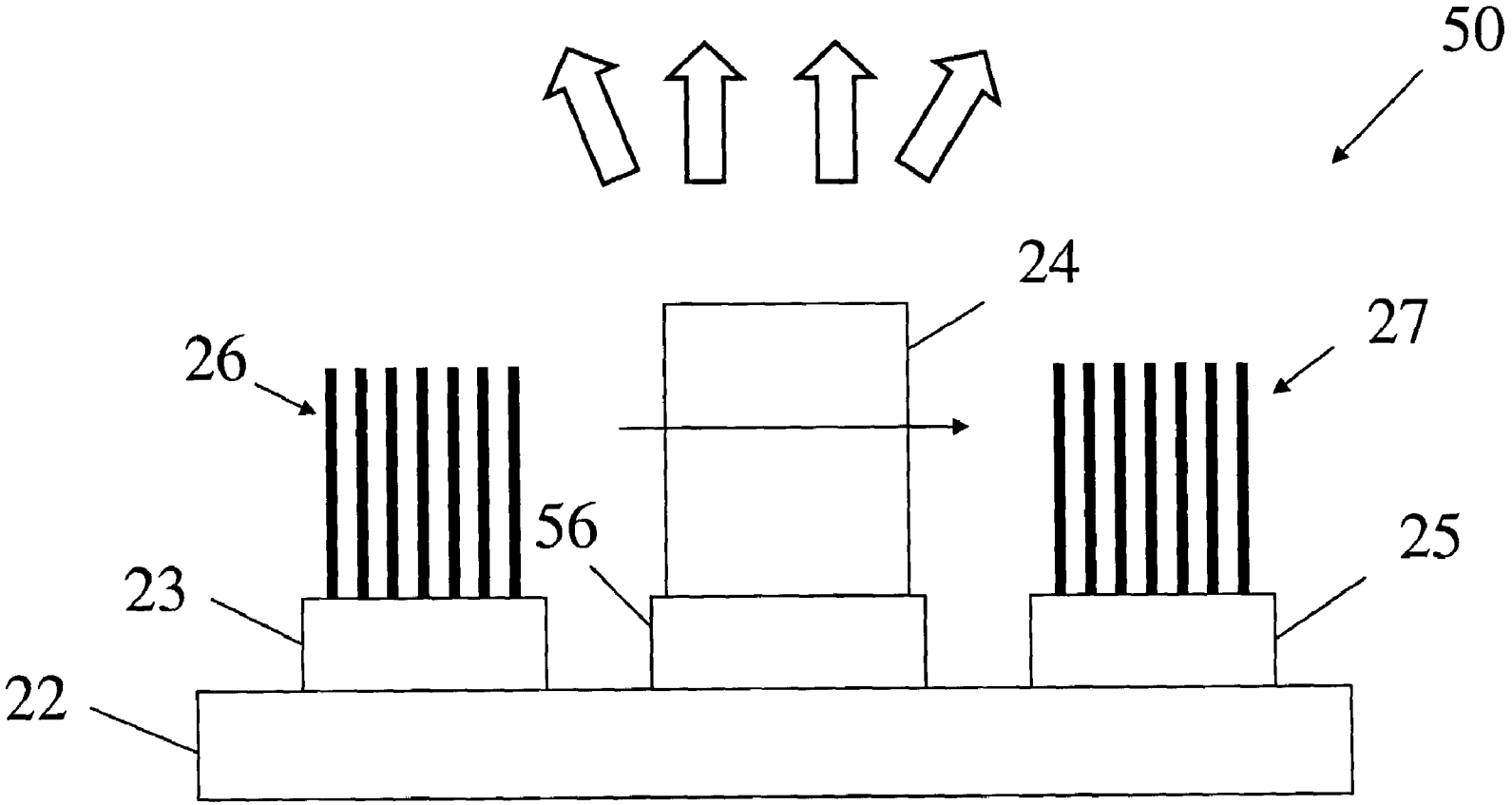
FIG. 5A is a schematic diagram of an FED device in accordance with still another embodiment of the present invention.

FIG. 5A is a schematic diagram of an FED device 50 in accordance with still another embodiment of the present invention. Referring to FIG. 5A, FED device 50 has a similar structure to FED 20 shown in FIG. 2A except a third conductive layer 56. Third conductive layer 56, having a thickness in the order of one micrometer, is formed on substrate 20 by, for example, a PVD process. Suitable material for third conductive layer 56 includes but is not limited to one of Al or Ag. Phosphor layer 24 is formed on third conductive layer 56, which functions to discharge electrons accumulated in phosphor layer 24.

Figure 5B:
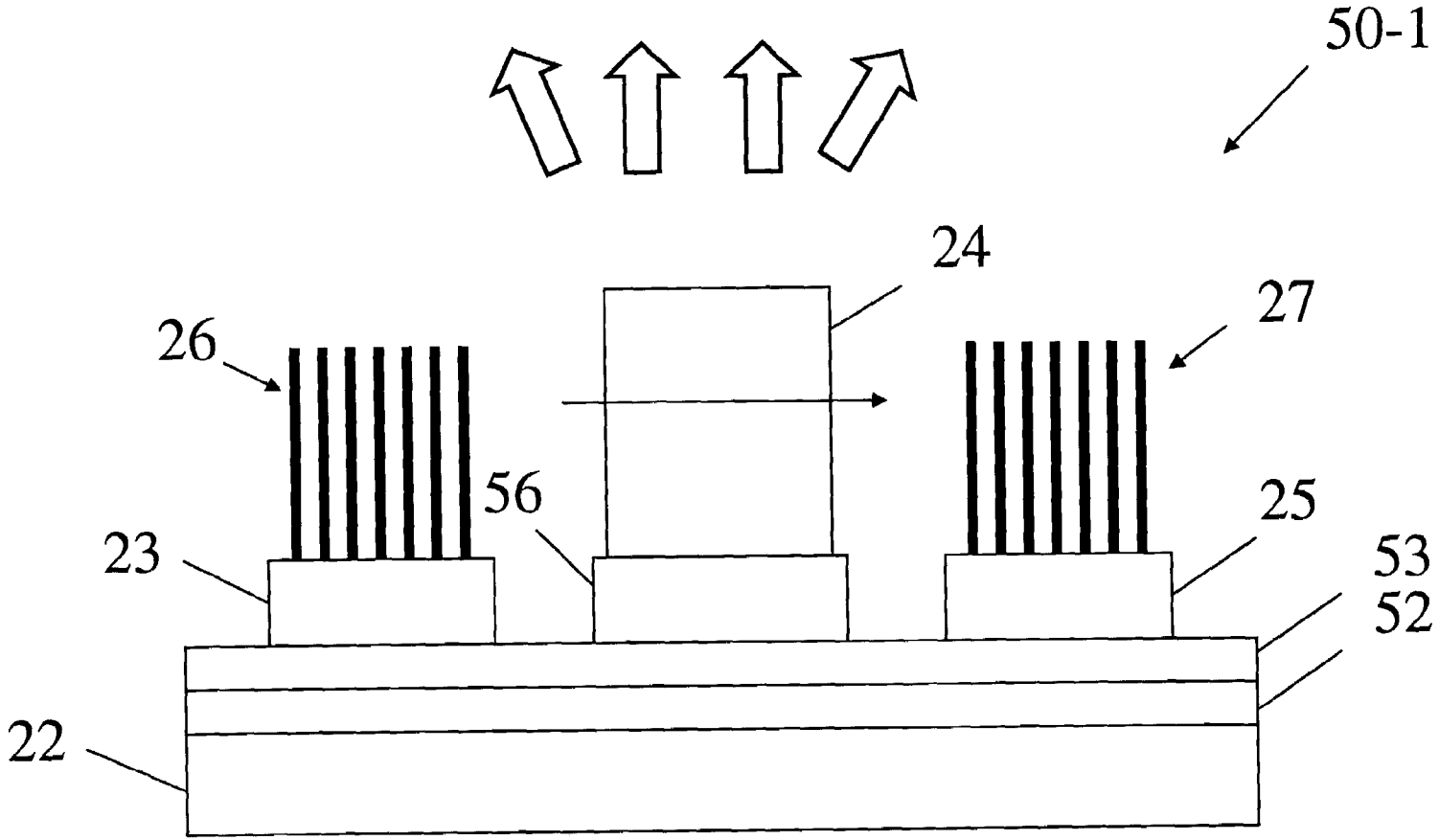
FIG. 5B is a schematic diagram of an FED device in accordance with yet another embodiment of the present invention.

FIG. 5B is a schematic diagram of an FED device 50-1 in accordance with yet another embodiment of the present invention. Referring to FIG. 5B, FED device 50-1 has a similar structure to FED 50 shown in FIG. 5A except a reflecting layer 52 and a dielectric layer 53. Reflecting layer 52, which is similar to reflecting layer 42 shown in FIG. 4A in material and dimensional parameters, functions to enhance luminescence provided by FED 50-1. Dielectric layer 53, which is similar to dielectric layer 43 shown in FIG. 4A in material and dimensional parameters, functions to provide electric isolation between reflecting layer 52 and conductive layers 23 and 25 of FED device 50-1.

Figure 5C:
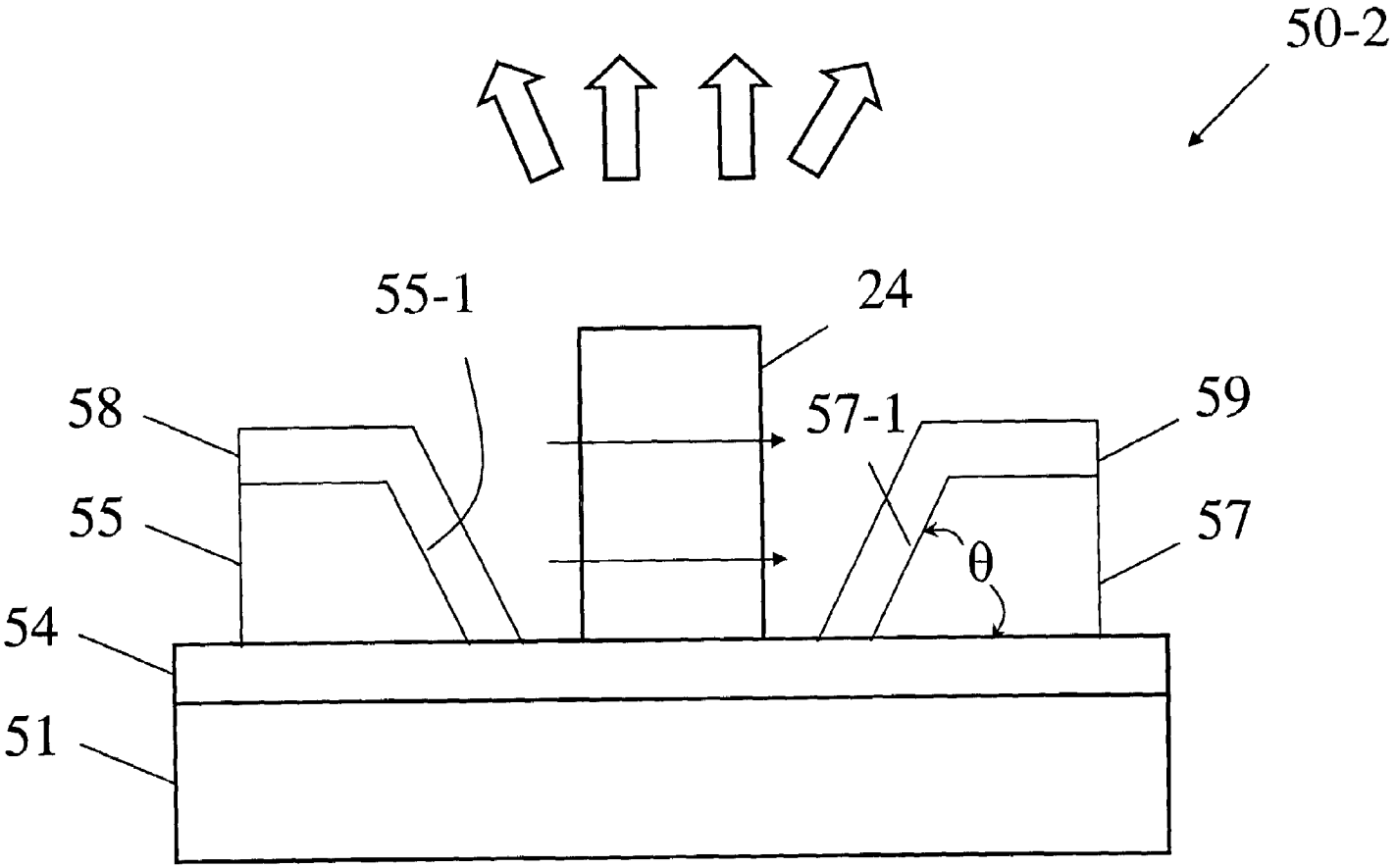
FIG. 5C is a schematic diagram of an FED device in accordance with still another embodiment of the present invention.

FIG. 5C is a schematic diagram of an FED device 50-2 in accordance with still another embodiment of the present invention. Referring to FIG. 5C, FED device 50-2 includes a metal substrate 51, a dielectric layer 54, a first conductive layer 55, a first emitter layer 58, a second conductive layer 57 and a second emitter layer 59. Metal substrate 51 functions to serve as a reflecting layer for reflecting light emitted from phosphor layer 24. Dielectric layer 54 provides necessary electrical isolation between metal substrate 51 and first conductive layer 55 and second conductive layer 57. First conductive layer 55 includes a sloped sidewall 55-1 facing toward phosphor layer 24. Likewise, second conductive layer 57 include a sloped sidewall 57-1 facing toward phosphor layer 24. An angle θ between sloped sidewall 55-1 or 57-1 and a top surface (not numbered) of dielectric layer 54 is approximately 60°. Sloped sidewalls 55-1 and 57-1 help reduce the risk of a discontinued first emitter layer 58 or second emitter layer 59, which may otherwise occur in conductive layers having only vertical sidewalls.

Figure 5D:
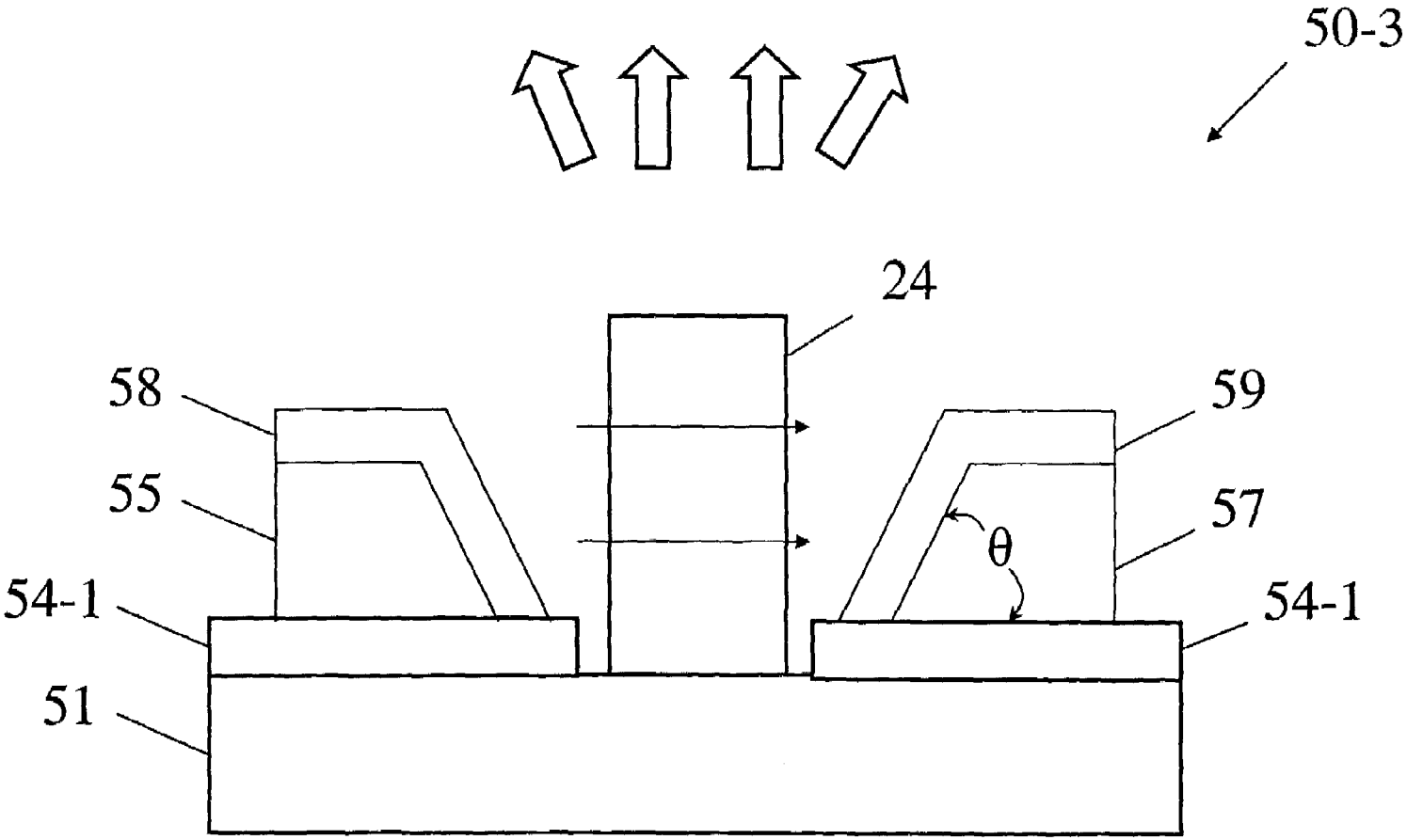
FIG. 5D is a schematic diagram of an FED device in accordance with yet another embodiment of the present invention.

FIG. 5D is a schematic diagram of an FED device 50-3 in accordance with yet another embodiment of the present invention. Referring to FIG. 5D, FED device 50-3 has a similar structure to FED 50-2 shown in FIG. 5C except a dielectric layer 54-1, which does not continuously extend on metal substrate 51. Phosphor layer 24 is disposed on metal substrate 51, which functions to serve as a ground base for phosphor layer 24.

Figure 6:
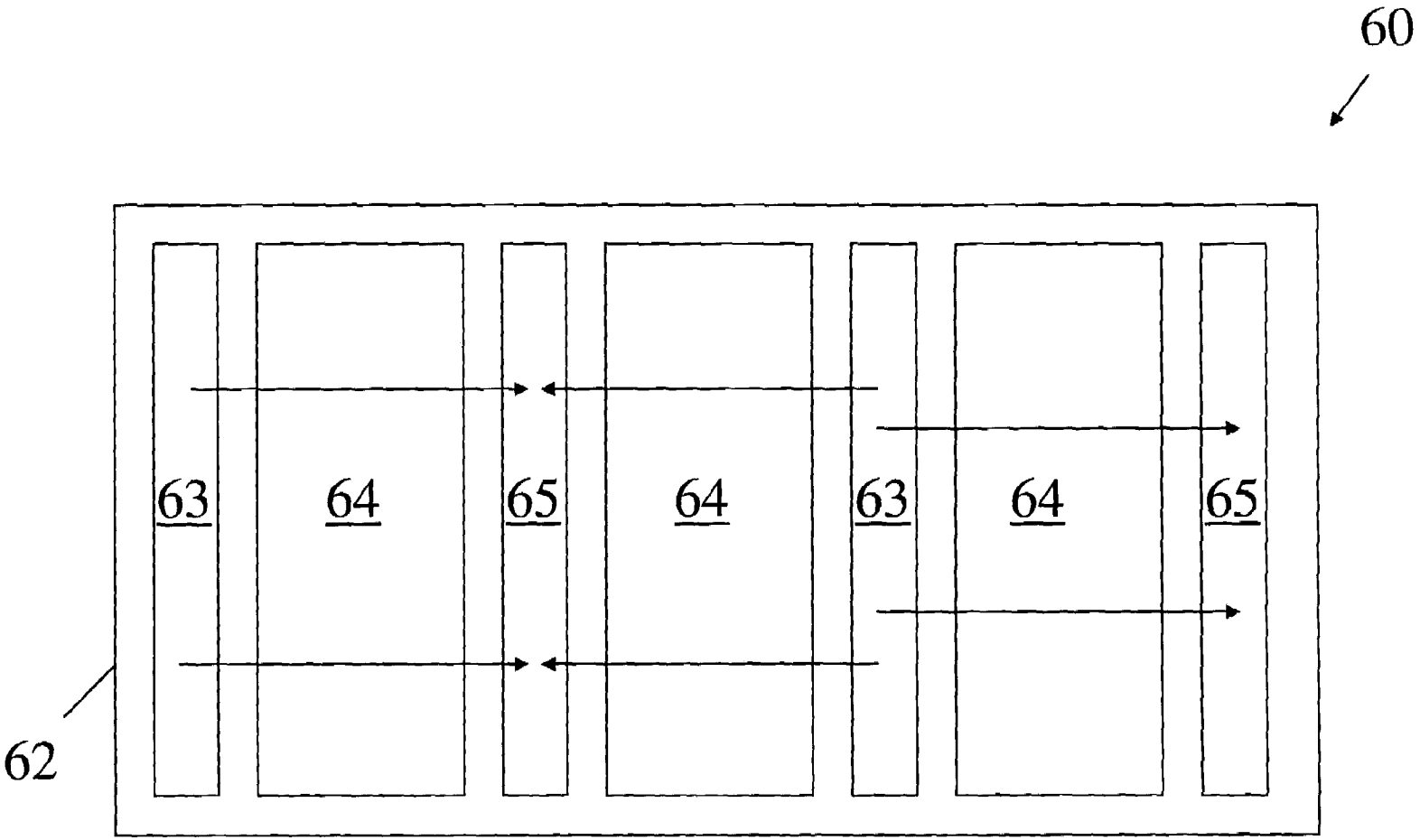
FIG. 6 is a schematic diagram of an FED device in accordance with yet still another embodiment of the present invention.

FIG. 6 is a schematic diagram of an FED device 60 in accordance with yet still another embodiment of the present invention. Referring to FIG. 6, FED device 60 includes a substrate 62, a plurality of first electrodes 63, a plurality of second electrodes 65, and a plurality of phosphor layers 64. Each of the plurality of first electrodes 63 formed over substrate 62, having a similar structure as first conductive layer 23 previously discussed, functions to serve as a cathode. Each of the plurality of second electrodes 65 formed over substrate 62, having a similar structure as second conductive layer 25 previously discussed, functions to serve as an anode. Each of the plurality of phosphor layers 64, formed over substrate 62, is disposed between one of the plurality of first electrodes 63 and one of the plurality of second electrodes 65. FED device 60 functions to serve as a light source rather than a display device.

Figure 7:
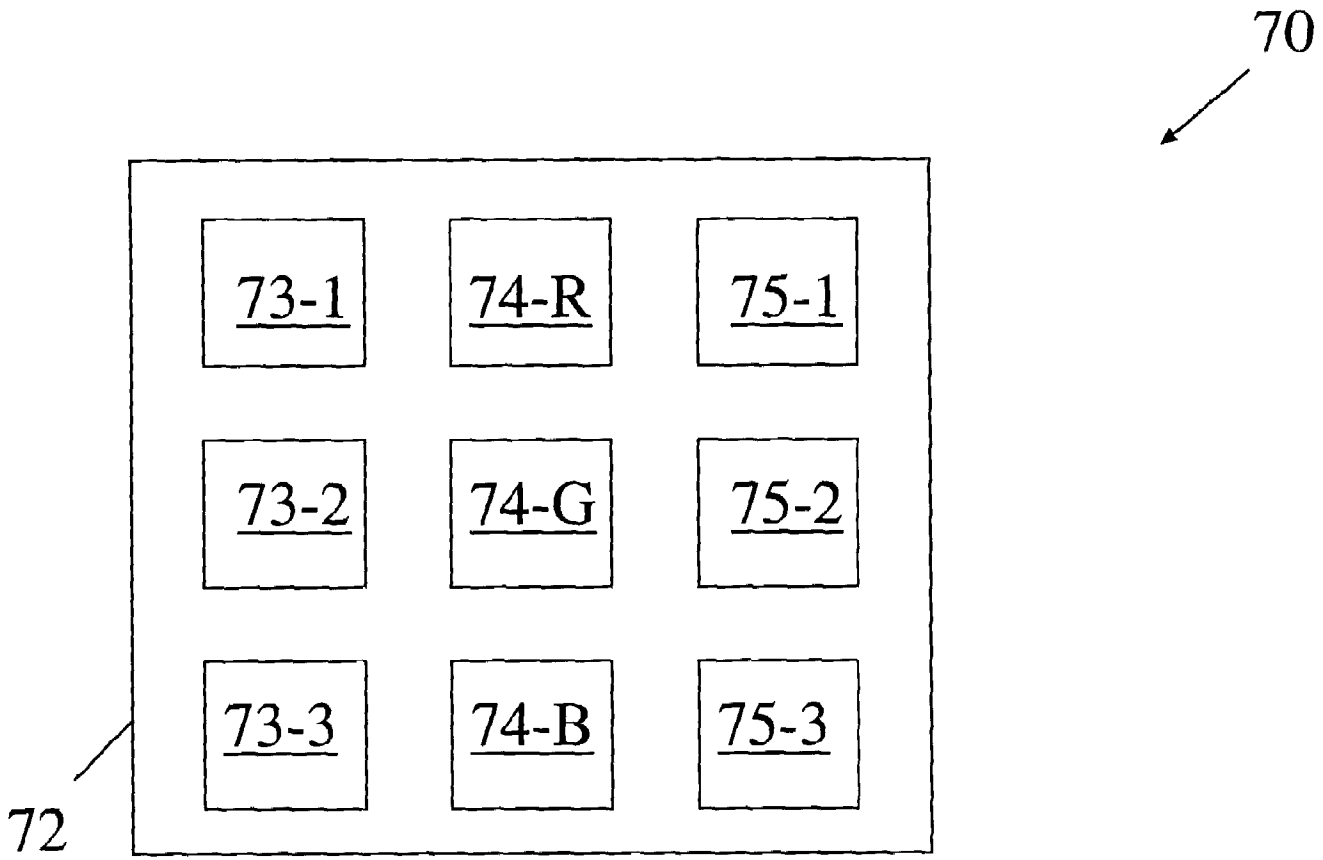
FIG. 7 is a schematic diagram of an FED device in accordance with still another embodiment of the present invention.

FIG. 7 is a schematic diagram of an FED device 70 in accordance with still another embodiment of the present invention. Referring to FIG. 7, FED device 70, which may function to serve as a light source or a pixel, includes a substrate 72, first electrodes 73-1, 73-2 and 73-3, second electrodes 75-1, 75-2 and 75-3, and phosphor layers 74-R, 74-G and 74-B. Phosphor layer 74-R, provided for red light emission, is disposed between first electrode 73-1 and second electrode 75-1, which altogether form a first sub-pixel of FED device 70. In addition, phosphor layer 74-G, provided for green light emission, is disposed between first electrode 73-2 and second electrode 75-2, which altogether form a second sub-pixel of FED device 70. Furthermore, phosphor layer 74-B, provided for blue light emission, is disposed between first electrode 73-3 and second electrode 75-3, which altogether form a third sub-pixel of FED device 70.

Figure 8:
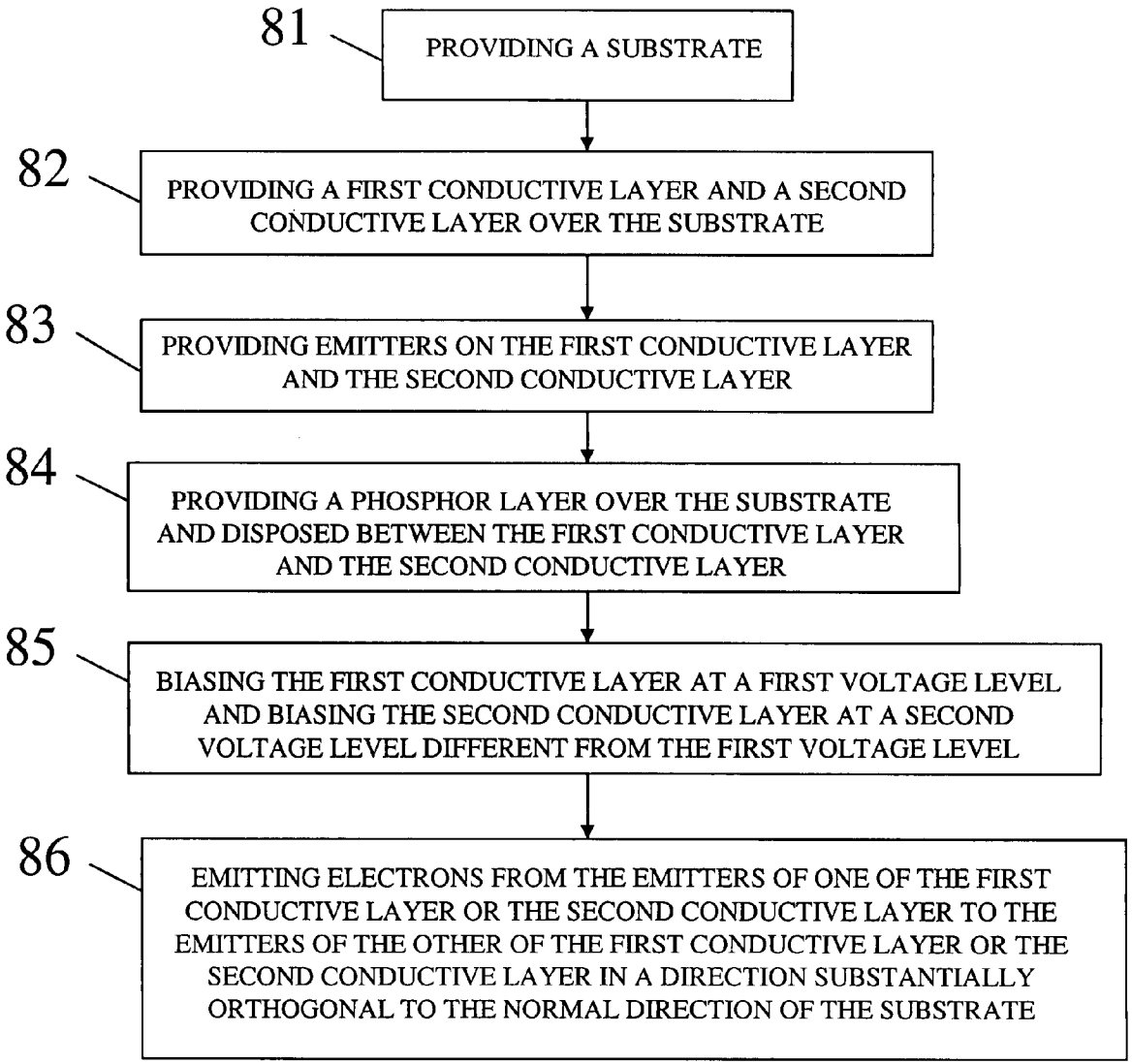
FIG. 8 is a flow diagram illustrating a method of operating an FED device in accordance with one embodiment of the present invention.

FIG. 8 is a flow diagram illustrating a method of operating an FED device in accordance with one embodiment of the present invention. Referring to FIG. 8, at step 81, a substrate is provided. Next, at step 82, a first conductive layer formed over the substrate and a second conductive layer formed over the substrate are provided. The first conductive layer is spaced apart from the second conductive layer. At step 83, emitters are provided on the first conductive layer and the second conductive layer. Next, at step 84, a phosphor layer formed over the substrate and disposed between the first conductive layer and the second conductive layer is provided. Skilled persons in the art will understand that after packaging, the phosphor layer, first conductive layer, second conductive layer and emitters are maintained at a vacuum of, for example, approximately $10^{-6}$ Torr to ensure continued accurate emission of electrons. At step 85, the first conductive layer is biased at a first voltage level, and the second conductive layer is biased at a second voltage level different from the first voltage level. At step 86, electrons are emitted from one of the first conductive layer or the second conductive layer to the other of the first conductive layer or the second conductive layer through the phosphor layer in a direction substantially orthogonal to the normal direction of the substrate.

In describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

It will be appreciated by those skilled in the art that changes could be made to the preferred embodiments described above without departing from the broad inventive concept thereof. It is understood, therefore, that this invention is not limited to the particular embodiments disclosed, but is intended to cover modifications within the spirit and scope of the present application as defined by the appended claims.

We claim:

1. A field emission device, comprising:

a substrate;

a first conductive layer formed over the substrate biased at a first voltage level;

a second conductive layer formed over the substrate biased at a second voltage level different from the first voltage level;

emitters formed on the first conductive layer and the second conductive layer for transmitting electrons; and a phosphor layer formed over the substrate being disposed between the first conductive layer and the second conductive layer, wherein the electrons are transmitted from one of the first conductive layer and the second conductive layer through the phosphor layer to the other of the first conductive layer and the second conductive layer in a direction substantially orthogonal to the normal direction of the substrate.

2. The device of claim 1, further comprising a reflecting layer formed on the substrate.

3. The device of claim 2, further comprising a dielectric layer formed on the reflecting layer.

4. The device of claim 3, wherein the first conductive layer and the second conductive layer are disposed on the dielectric layer, and the phosphor layer is disposed on the reflecting layer.

5. The device of claim of claim 3, wherein the first conductive layer, the second conductive layer and the phosphor layer are disposed on the dielectric layer.

6. The device of claim 1, wherein the emitters include tips, and the tips of the emitters formed on at least one of the first conductive layer and the second conductive layer are directed in a direction to facilitate transmission of the electrons through the phosphor layer.

7. The device of claim 1, further comprising a third conductive layer formed between the substrate and the phosphor layer.

8. The device of claim 3, further comprising a third conductive layer formed between the dielectric layer and the phosphor layer.

9. The device of claim 1, wherein the emitters includes one of carbon nanotube, carbon nanosheet, carbon nanowall, diamond film, diamond-like carbon film, GaN, GaB, W-film, Mo-film, Si, ZnO or spindle array.

10. The device of claim 1, wherein the substrate includes one of glass, polymer, Teflon, ceramic, silicon layer provided with a silicon oxide film or silicon layer provided with a silicon nitride film.

11. The device of claim 1, wherein the substrate comprises a metal substrate.

12. The device of claim 11, wherein at least one of the first conductive layer and the second conductive layer includes a sloped sidewall facing toward the phosphor layer.

13. The device of claim 11, wherein the phosphor layer is disposed on the metal substrate.

14. A field emission device, comprising:

a substrate;

a first electrode formed over the substrate biased at a first voltage level;

a second electrode formed over the substrate biased at a second voltage level greater than the first voltage level;

first emitters corresponding to the first electrode for emitting electrons in a direction substantially orthogonal to the normal direction of the substrate; and second emitters corresponding to the second electrode for receiving electrons emitted from the first emitters.

15. The device of claim 14, further comprising a phosphor layer disposed between the first electrode and the second electrode through which the electrons are transmitted.

16. The device of claim 14, further comprising a phosphor layer covering the first electrode and the second electrode.

17. The device of claim 14, further comprising a reflecting layer formed on the substrate.

18. The device of claim 17, further comprising a dielectric layer formed on the reflecting layer.

19. The device of claim 15, further comprising a third conductive layer formed between the substrate and the phosphor layer.

20. The device of claim 18, further comprising a phosphor layer formed over the substrate and a third conductive layer formed between the dielectric layer and the phosphor layer.

21. The device of claim 18, further comprising a phosphor layer formed on the dielectric layer.

22. The device of claim 18, further comprising a phosphor layer formed on the reflecting layer.

23. The device of claim 15, wherein the first emitters include tips directed toward the phosphor layer.

24. The device of claim 15, wherein the second emitters include tips directed toward the phosphor layer.

25. A field emission device, comprising:

a first electrode formed on a surface;

a second electrode formed on substantially the same surface being spaced apart from the first electrode; and emitters formed on the first electrode and the second electrode for transmitting electrons in a direction substantially orthogonal to the normal direction of the surface.

26. The device of claim 25, further comprising a phosphor layer disposed between the first electrode and the second electrode through which the electrons are transmitted.

27. A field emission device, comprising:

a substrate;

a plurality of first electrodes formed over the substrate being biased at a first voltage level;

a plurality of second electrodes formed over the substrate being biased at a second voltage level different from the first voltage level;

a plurality of phosphor layers formed over the substrate, each of the plurality of phosphor layers being disposed between one of the plurality of first electrodes and one of the plurality of second electrodes; and emitters formed on each of the plurality of first electrodes and each of the plurality of second electrodes for transmitting electrons through the plurality of phosphor layers in a direction substantially orthogonal to the normal direction of the substrate.

28. The device of claim 27, further comprising a reflecting layer formed on the substrate.

29. The device of claim 28, further comprising a dielectric layer formed on the reflecting layer.

30. The device of claim 27, further comprising a metal layer disposed between each of the plurality of phosphor layers and the substrate.

31. The device of claim 29, further comprising a metal layer disposed between each of the plurality of phosphor layers and the dielectric layer.

32. A field emission device, comprising:

a substrate;

a first unit for red light emission formed over the substrate including a first cathode, a first anode and a first phosphor layer disposed between the first cathode and the first anode;

a second unit for green light emission formed over the substrate including a second cathode, a second anode and a second phosphor layer disposed between the second cathode and the second anode;

a third unit for blue light emission formed over the substrate including a third cathode, a third anode and a third phosphor layer disposed between the third cathode and the third anode; and emitters formed on each of the first, second and third cathodes and each of the first, second and third anodes for transmitting electrons through the first, second and third phosphor layers in a direction substantially orthogonal to the normal direction of the substrate.

33. The device of claim 32, wherein the first unit, the second unit and the third unit are formed in an array.

34. A method of operating a field emission device, comprising:

providing a substrate;

providing a first conductive layer over the substrate;

providing a second conductive layer over the substrate;

providing emitters on the first conductive layer and the second conductive layer;

providing a phosphor layer over the substrate between the first conductive layer and the second conductive layer;

biasing the first conductive layer at a first voltage level;

biasing the second conductive layer at a second voltage level different from the first voltage level; and emitting electrons from one of the first conductive layer or the second conductive layer to the other of the first conductive layer or the second conductive layer through the phosphor layer in a direction substantially orthogonal to the normal direction of the substrate.

35. The method of claim 34, further comprising reflecting light provided by the phosphor layer.

36. The method of claim 34, further comprising directing tips of the emitters in a direction to facilitate transmission of the electrons.

37. The method of claim 34, further comprising discharging electrons accumulated in the phosphor layer.

38. A method of operating a field emission device, comprising:

providing a substrate;

providing a first electrode over the substrate;

biasing the first electrode at a first voltage level;

providing a second electrode over the substrate;

biasing the second electrode at a second voltage level greater than the first voltage level;

providing first emitters corresponding to the first electrode;

providing second emitters corresponding to the second electrode; and emitting electrons from the first emitters to the second emitters in a direction substantially orthogonal to the normal direction of the substrate.

39. The method of claim 38, further comprising providing a phosphor layer between the first electrode and the second electrode.

40. The method of claim 38, further comprising providing a phosphor layer covering the first electrode and the second electrode.

41. The method of claim 39, further comprising directing the first emitters toward the phosphor layer.

42. The method of claim 39, further comprising directing the second emitters toward the phosphor layer.

43. A method of operating a field emission device, comprising:

providing a first electrode on a surface;

providing a second electrode on substantially the same surface being spaced apart from the first electrode;

providing emitters on the first electrode and the second electrode; and transmitting electrons in a direction substantially orthogonal to the normal direction of the surface.

44. The method of claim 43, further comprising providing a phosphor layer between the first electrode and the second electrode.

45. The method of claim 44, further comprising reflecting light provided by the phosphor layer.

46. The method of claim 44, further comprising discharging electrons accumulated in the phosphor layer.

* * * * *

UNITED STATES PATENT AND TRADEMARK OFFICE

CERTIFICATE OF CORRECTION

PATENT NO. : 7,598,665 B2
APPLICATION NO. : 11/264318
DATED : October 6, 2009
INVENTOR(S) : Li et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1009 days.

Signed and Sealed this

Twenty-eighth Day of September, 2010

David J. Kappos

David J. Kappos
*Director of the United States Patent and Trademark Office*